US006681705B2

(12) United States Patent
Wetterberg

(10) Patent No.: US 6,681,705 B2
(45) Date of Patent: Jan. 27, 2004

(54) SUPPORT STRUCTURE AND METHOD OF ASSEMBLY THEREOF

(75) Inventor: Brandon Robert Wetterberg, Ankeny, IA (US)

(73) Assignee: Hirsh Industries Inc., Des Moines, IA (US)

( * ) Notice: Subject to any disclaimer, the term of this patent is extended or adjusted under 35 U.S.C. 154(b) by 0 days.

(21) Appl. No.: 10/075,070

(22) Filed: Feb. 12, 2002

(65) Prior Publication Data

US 2002/0171338 A1 Nov. 21, 2002

Related U.S. Application Data

(60) Provisional application No. 60/292,152, filed on May 18, 2001.

(51) Int. Cl.[7] ..... A47B 47/00

(52) U.S. Cl. ..... 108/155; 108/107; 248/250; 312/265.4

(58) Field of Search ..... 312/265.1, 265.2, 312/265.3, 265.4; 108/106, 107, 147.15, 147.11, 147.16, 155; 248/243, 250

(56) References Cited

U.S. PATENT DOCUMENTS

| | | | | |
|---|---|---|---|---|
| 1,945,507 A | | 2/1934 | Bales | |
| 2,971,657 A | | 2/1961 | Zadek | |
| 2,992,744 A | | 7/1961 | Fohn | |
| 3,021,013 A | | 2/1962 | Shivek | |
| 3,120,201 A | | 2/1964 | Kate | |
| 3,130,693 A | | 4/1964 | Shell | |
| 3,187,693 A | | 6/1965 | Hamilton et al. | |
| 3,602,159 A | | 8/1971 | Marschak | |
| 3,981,250 A | | 9/1976 | Anthony | |
| 4,064,996 A | * | 12/1977 | Shillum | 211/191 |
| 4,158,998 A | | 6/1979 | Clement | |
| 4,317,523 A | | 3/1982 | Konstant et al. | |
| 4,699,067 A | | 10/1987 | Okopny | |
| 4,757,769 A | | 7/1988 | Suttles | |
| 5,348,170 A | | 9/1994 | Thornley et al. | |
| 5,348,385 A | * | 9/1994 | Berg | 312/247 |
| 5,463,966 A | | 11/1995 | Nilsson | |
| 5,628,256 A | | 5/1997 | Lazarus | |
| 5,722,544 A | * | 3/1998 | Williams | 211/188 |
| 5,803,274 A | * | 9/1998 | Scheveloff | 211/87.01 |
| 6,190,081 B1 | * | 2/2001 | Besserer et al. | 403/231 |
| 6,206,494 B1 | * | 3/2001 | Benner et al. | 312/265.4 |

FOREIGN PATENT DOCUMENTS

| | | |
|---|---|---|
| EP | 0 427 914 A1 | 5/1991 |
| EP | 0 538 046 A1 | 4/1993 |
| FR | 2229512 | 12/1974 |
| GB | 1046810 | 10/1966 |
| GB | 2 218 898 A | 11/1989 |

OTHER PUBLICATIONS

International Search Report for PCT/US 02/14330 dated Nov. 15, 2002.

* cited by examiner

*Primary Examiner*—Ramon O. Ramirez
(74) *Attorney, Agent, or Firm*—Katten Muchin Zavis Rosenman; John S. Paniaguas

(57) ABSTRACT

A support structure has a number of posts with flanges and slots formed in the flanges. The support structure also has a number of aprons with end tabs that are inserted into respective post flange slots. A gap defined by the apron end tabs and an edge of the apron creates an interference fit with a slot lip of the flange slot. The disclosed interlock of the aprons to the posts creates a stable support structure that has aesthetic value. The disclosed interlock further provides the capability of creating various support structures (e.g., shelving assemblies, workbenches, cabinets, storage assemblies).

18 Claims, 5 Drawing Sheets

SUPPORT STRUCTURE AND METHOD OF ASSEMBLY THEREOF

CROSS-REFERENCE TO RELATED APPLICATIONS

This application claims the priority date benefit of Provisional U.S. Patent Application Ser. No. 60/292,152, filed May 18, 2001, entitled "Shelving Apparatus and Method of Assembly", which is hereby incorporated by reference.

BACKGROUND

Readily assembled support or work structures, such as shelving units or workbenches, have been in the market and in use for years. Various forms of assembly techniques have been employed in these support structures. A common form of shelving unit uses a nut and bolt type assembly for post and apron connections. Such assemblies, though effective, have several limitations. Each unit has a number of parts that need to be assembled. Each bolt, nut and washer, if provided, needs to be assembled and tightened. Each part that needs to be put together and tightened or fastened creates additional assembly time. Also, such assemblies require an assortment of tools that the shelf builder has to have, such as screwdrivers (Phillips or flat-head), pliers, wrenches, etc. Without the required tools, the shelf builder is unable to build the shelf. Further, the connections of such nut and bolt assemblies have a tendency to loosen over time, making the shelving unit unstable.

Nut and bolt assemblies and other types of assemblies, such as rivet-type assemblies, also tend to lack aesthetic appeal because the fastener in these types of assemblies passes through the vertical post and is exposed to someone viewing the shelving unit. As such, these assembly types are usually only used in utilitarian work spaces. Present assembly types also lack necessary flexibility. Due to the design and structure of most present assembly structures, they are usually not reconfigurable (i.e., cannot be converted from a shelving unit to a workbench or other structure or vice versa). Even when such assemblies are reconfigurable, they are very difficult to reconfigure from a shelving unit to a workbench or some other structure without considerable effort.

Accordingly, there is a need for a readily assembled support structure that is easy to assemble, using minimal tools, aesthetically pleasing and incorporating a degree of flexibility to be configured and used in different ways.

SUMMARY

According to one aspect of the present invention, a kit for forming a support structure includes a number of posts, a number of aprons and a support panel. Each post has a pair of flanges with each flange having a series of slots formed in it such that each slot defines a slot lip. Each apron has two ends with each end having at least one end tab extending from it, wherein each tab and respective apron edge define a gap. When assembled, each end tab is disposed in a respective post flange slot such that the slot lips of the flange are disposed in the gaps formed between the end tabs and the edge of the apron. The support panel is placed on a set of the aprons.

According to one aspect of the present invention, a support structure has a number of posts and a number of aprons. Each post has a pair of flanges, and each flange has a series of slots formed in it such that each slot defines a slot lip. Each apron has two ends, and each end has an edge and at least a pair of end tabs extending from the edge. Each tab and respective apron edge define a gap, such that the end tabs of each end of an apron are disposed in respective post flange slots such that the slot lips of the flange are disposed in the gaps formed between the end tabs and the edge of the apron. The support structure further includes a support panel. The support panel rests on a set of the aprons.

According to another aspect of the present invention, the interaction of the slot lip with the gap formed by the end tab and the apron edge is an interference fit. The pair of flanges of the post may define a channel. The channel retains the edge of the support panel. The support structure may also have a back stop that may be retained vertically in the channel.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
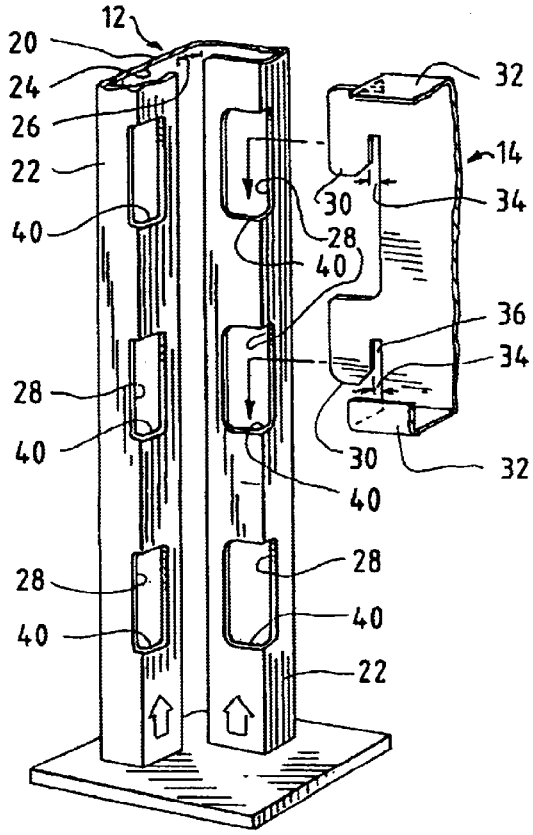
FIG. 1 illustrates the interlock mechanism of the present invention.

Referring now to FIG. 1, the interlock mechanism used in the support structures of the present invention is depicted. The interlock mechanism of the present invention utilizes a post edge interlock, which, as explained in detail below, allows the flexibility to form different structures using this interlock. The structural elements of the structures formed using such interlock mechanism include posts 12 and braces or aprons 14. The posts 12 and braces and aprons 14 are usually formed metal pieces. Each post 12 is formed into a right angled portion 20 integral with two C-flange segments 22. Each C-flange 22 and the right angle portion 20 define a pocket 24. In this embodiment, the C-flanges 22 define a channel 26 between them. Also, formed along the length of each C-flange 22 are a series of slots 28. Each slot 28 defines a slot lip 40. Each apron 14 of an assembly has a number of end tabs 30 formed at each end of the apron 14. In this embodiment, each apron has two tabs on each end. The end tabs 30 form a gap 34 between the tab 30 and the apron edge 36. The apron 14, as depicted, may be formed to have two flanges 32 along its edges. The flanges 32 provide the apron 14 with greater strength and resistance to bending.

When assembling a structure using the interlock mechanism of the present invention, the posts 12 and aprons 14 are interconnected by aligning the tabs 30 of an apron 14 with corresponding post slots 28 and then inserting the tabs 30 into such slots 28. Once inserted, the gaps 34 formed by the apron end tabs 30 and the apron edges 36 are aligned with a respective slot lip 40, and the apron end tabs 30 are then forced down into the slot 28. The clearance of the gap 34 and the thickness of the slot lip 40 are manufactured such that when the tabs 30 are forced down into the slots 28, an interference fit is created between the tab 30, the slot lip 40 and the apron edge 36. The interference fit between the apron and the post can be of varying degree, but in a preferred embodiment it is such that a force no greater than a mallet tap is required to interlock each post 12 and apron 14. The interference fit between the end tabs 30, the slot lip 40 and the apron 14 creates a strong and stable interface between the post 12 and the apron 14. With the end tabs 30 in position, the end tabs 30 are disposed behind the right angle portion 20 of the post 12 and are hidden from someone looking at a finished assembly from an exterior view point. The interlock mechanism of the present invention, therefore, also enhances the aesthetic appeal of finished assemblies incorporating it.

Figure 2:
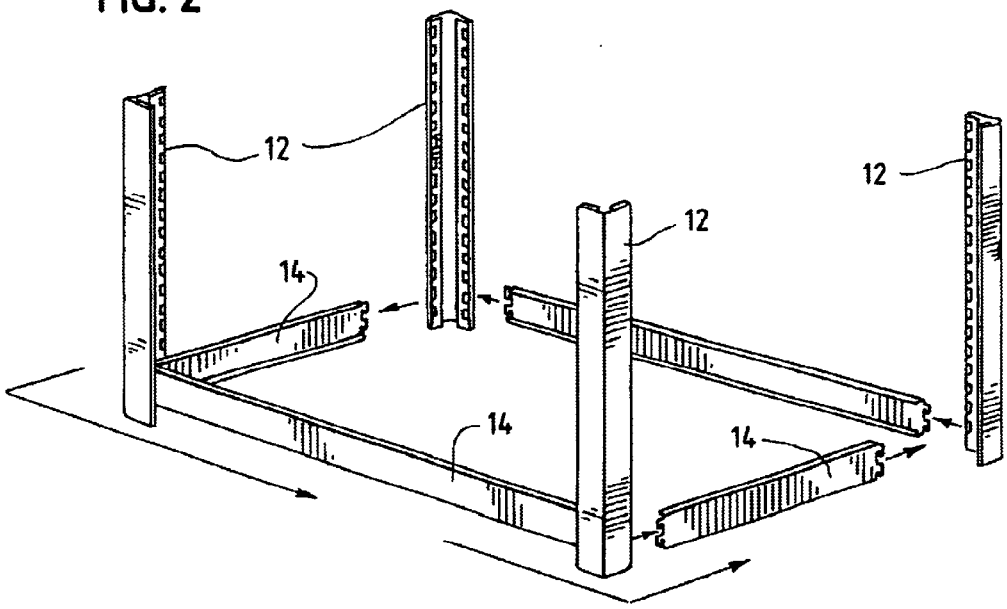
FIG. 2 is an apron and post assembly diagram of the present invention.

After one end of the apron 14 is inserted into one of the posts 12, the other end of the apron 14 is inserted into another post 12 and the apron end tabs 30 are forced into the post slot 28. As depicted in FIG. 2, once one apron 14 is connected, the structure assembler continues to connect the aprons 14 to the posts 12 in a similar manner until the provided aprons 14 are connected to the provided posts 12.

Figure 3:
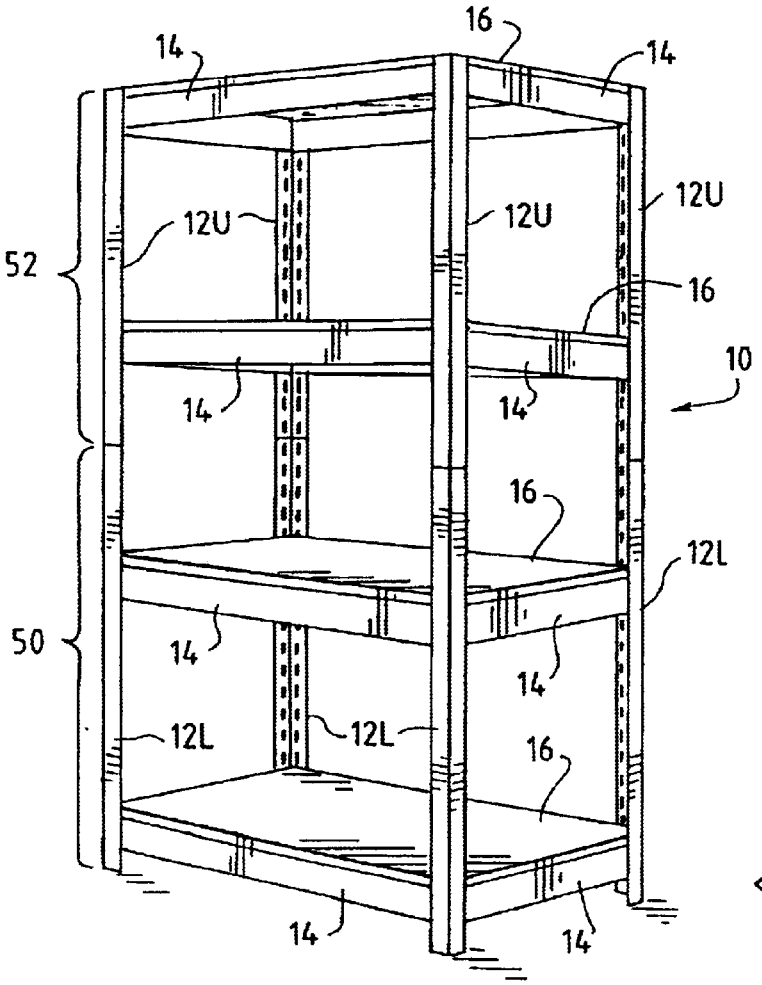
FIG. 3 illustrates an embodiment of an assembled shelving unit of the present invention.

Referring to FIG. 3, an embodiment of an assembled stand alone shelving unit 10 using the interlock mechanism of the present invention is depicted. The shelving unit 10 has a number of posts 12 and a number of braces or aprons 14. The aprons 14 interlock with the posts 12, as described in detail above, to form a stable, self-supporting shelving structure. The interlocking of the aprons and the posts creates such a stable platform that it is not necessary to use cross bracing with the unit of the present invention. In the assembled unit, the aprons 14 at each level support a shelf 16. The posts 12, due to their configuration, described above, act as channel guides to hold the shelves 16 in place. The shelving unit may be distributed as a disassembled kit with the kit including the necessary post, apron and shelving pieces.

To assemble the shelving unit, the post 12 is held upright on a shelving unit support surface, such as a floor. Some form of material (e.g., a cardboard or a rag) may be placed between the post 12 and the support surface to keep the support surface from being damaged. The tabs 30 of an apron 14 are then aligned with and inserted into a post slot 28. Once inserted, the gaps 34 formed by the apron end tabs 30 are aligned with the respective slot lip 40, and the apron end tabs 30 are then forced down into the slot 28. The apron tabs 30 engage the slot lips 40 of the slots 28 as described above.

Figure 4:
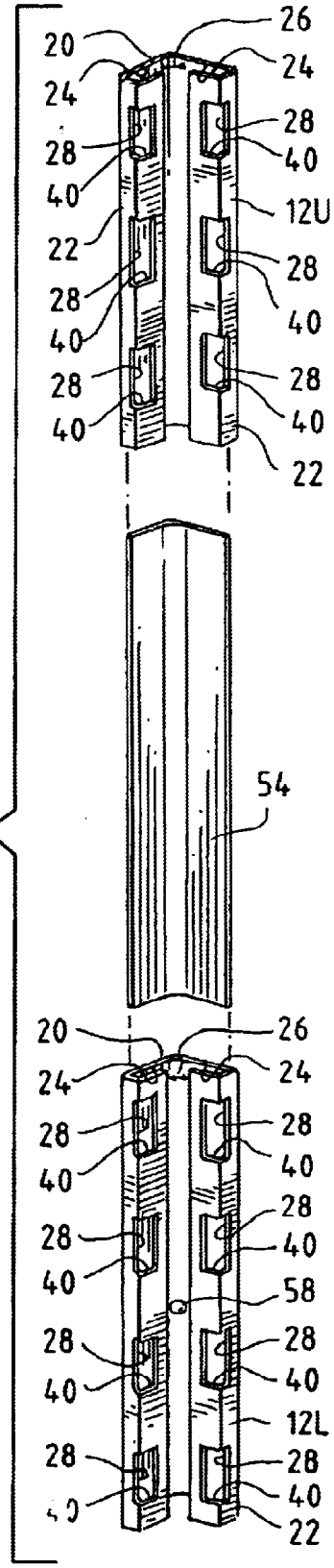
FIG. 4 is an assembly diagram illustrating a joiner and the interconnection of an upper assembly.

As depicted in FIG. 2, after one end of the apron 14 is inserted into one of the posts 12, the other end of the apron 14 is inserted into another post 12 and the apron end tabs 30 are forced into the post slot 28. Once one apron 14 is connected, the shelf assembler continues to connect the aprons 14 to the posts 12 in a similar manner until all of the aprons 14 at the first level 50 are connected to the posts 12 of the first level 50. In the embodiment depicted in FIG. 3, the shelving assembly 10 has two levels 50, 52. Once the first level 50 is complete, the shelf assembler adds the second, vertical level 52. The second level 52 may be connected to the first level 50 in a number of ways. In one embodiment, to add the second level 52, the shelf assembler first inserts joiners 54, as depicted in FIG. 4, into the pockets 24 formed in the lower posts 12L of the first level 50. The joiners 54 interact with a dimple 58 on the post 12L to keep the joiner 54 from sliding all the way into the post 12L. With the joiners 54 in place, upper posts 12U and additional aprons 14 are added to the upper level of the assembly in the same manner as described above for adding posts 12 and aprons 14 to the lower level of the assembly. In another embodiment, the second level 52 is added using aprons 14 to connect the upper posts 12U to the lower posts 12L. In this embodiment, the lower end tabs 30 of four aprons 14 are inserted into the top slots 28 of the lower posts 12L. To connect the upper posts 12U, the upper end tabs 30 of the same four aprons 14 are inserted into the bottom slots 28 of the upper posts 12U.

With all of the aprons 14 and posts 12 connected, the shelves 16 are then inserted into the shelving unit to complete the shelving assembly. At each level of aprons 14, a shelf 16 is placed on top of the top apron flanges 32. The channels 26 formed by the C-flanges 22 of each post 12 act to keep each shelf 16 firmly in place so the shelf does not shift during use.

Other embodiments of the present invention demonstrate the flexibility of the shelving unit of the present invention. Instead of building an upper, second level of the shelf assembly in a vertical arrangement as depicted in FIG. 3 and described above, the shelving unit may be assembled as horizontal side-by-side sections.

Figure 5:
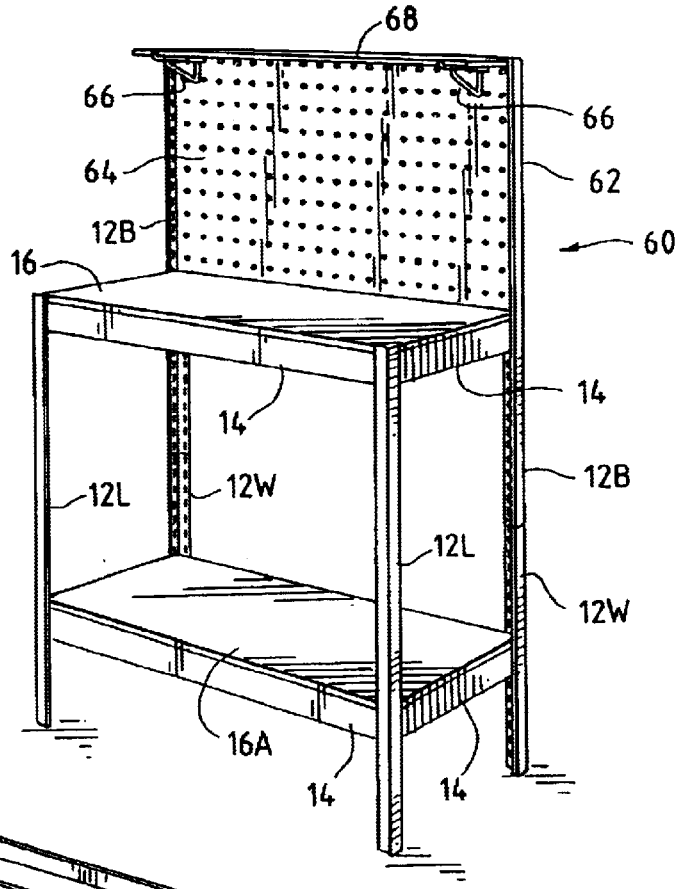
FIG. 5 illustrates an embodiment of an assembled workbench of the present invention.

The present invention may also be used to configure a workbench. Referring to FIG. 5, an embodiment of an assembled workbench 60 using the interlock mechanism of the present invention is depicted. The workbench 60, as with the shelving unit 10, has a number of posts 12 and a number of braces or aprons 14. The workbench 60 has set of short posts 12W which provide the back section 62 of the workbench 60 with added height.

To assemble the workbench 60, a front post 12L or a back, short post 12W is held upright on a support surface, such as a floor. Some form of material (e.g., a cardboard or a rag) may be placed between the post 12 and the support surface to keep the support surface from being damaged. The tabs 30 of an apron 14 are then aligned with and inserted into a post slot 28, as described above. After one end of the apron 14 is inserted into one of the posts 12, the other end of the apron 14 is inserted into another post 12 (either a front post 12L or a back, short post 12W) and the apron end tabs 30 are forced into the post slot 28. The shelf assembler continues to connect the aprons 14 of the first shelf 16A to the posts 12 in a similar manner until all of the aprons 14 and posts 12L, 12W for the first shelf 16A are connected. To add back posts 12B to the assembly, the shelf assembler first inserts joiners 54 into the back, short posts 12W and then slides the back posts 12B onto the joiners 54. The shelf assembler then connects the aprons 14 for a second, work surface level to the front posts 12L and the back posts 12B. With all of the aprons 14 and posts 12 connected, the shelves 16 are then inserted into the workbench unit. A back stop 64 is inserted into the channels 26 of the back posts 12B to create a workbench back stop surface which may be designed to hold tools or other equipment. The back stop 64 may be made from pegboard material or some other appropriate material. Support brackets 66 and a utility shelf 68 may also be provided. With a pegboard back stop 64, the support brackets 66 hook into holes in the pegboard, and the utility shelf 68 rests on top of the support brackets 66. The workbench 60, as with the shelving unit, may be distributed as a disassembled kit with the kit including the necessary post, apron, shelving and back stop pieces.

Figure 6A:
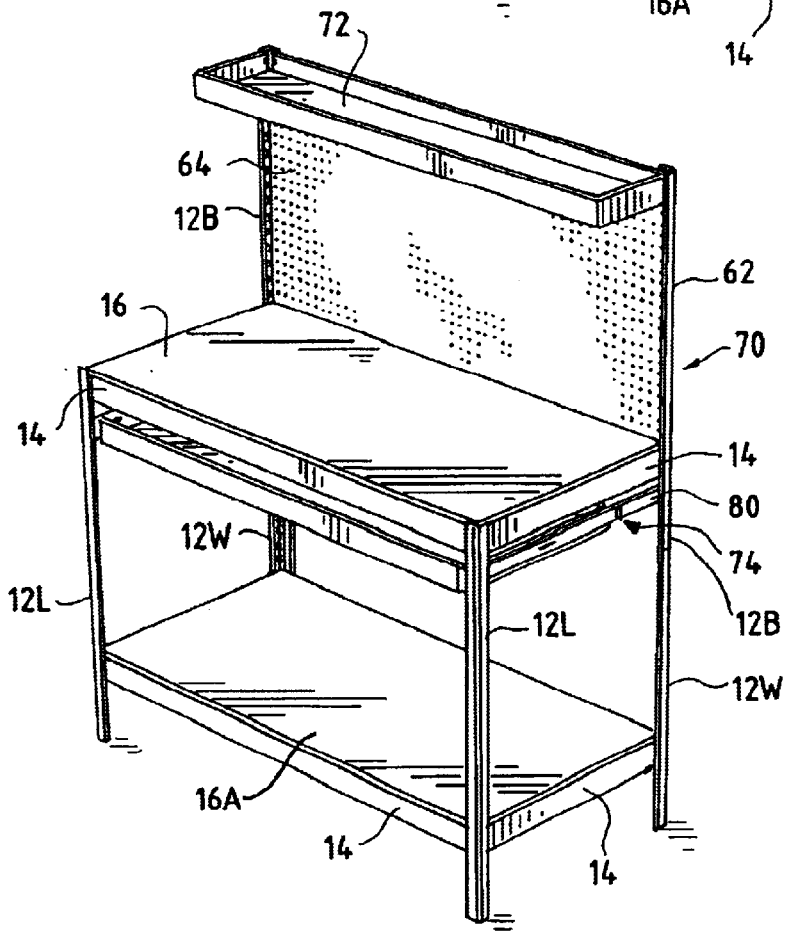
FIGS. 6A–C illustrate a further embodiment of an assembled workbench of the present invention having a work tray and a drawer assembly.
Figure 6B:
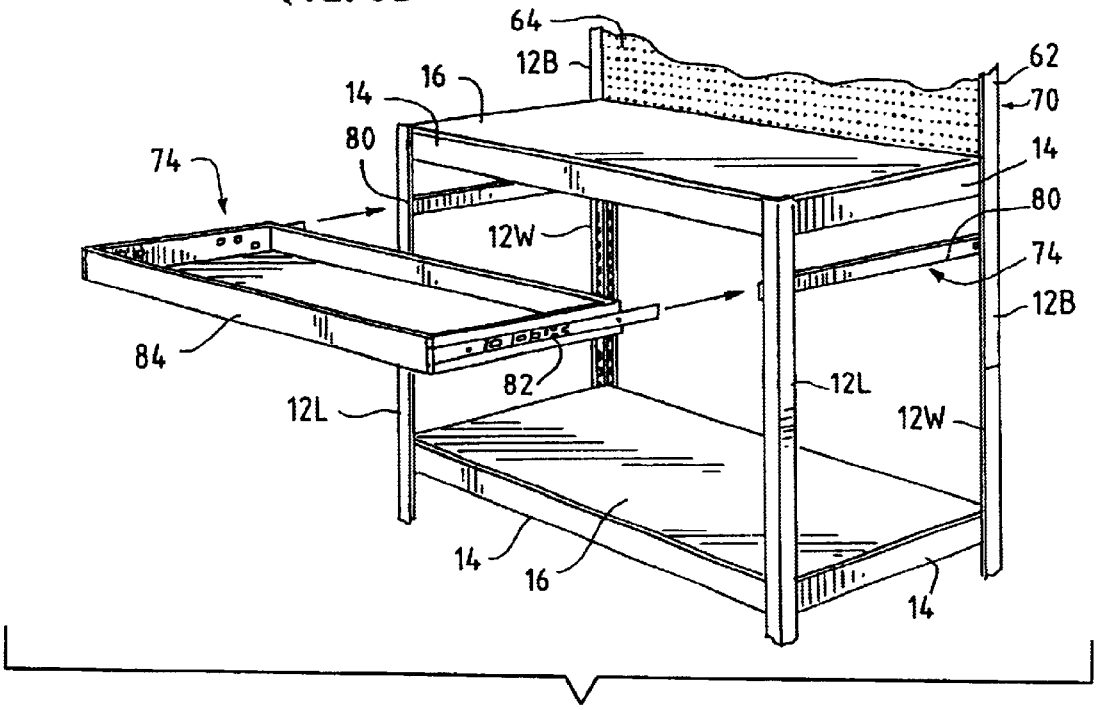
Figure 6C:
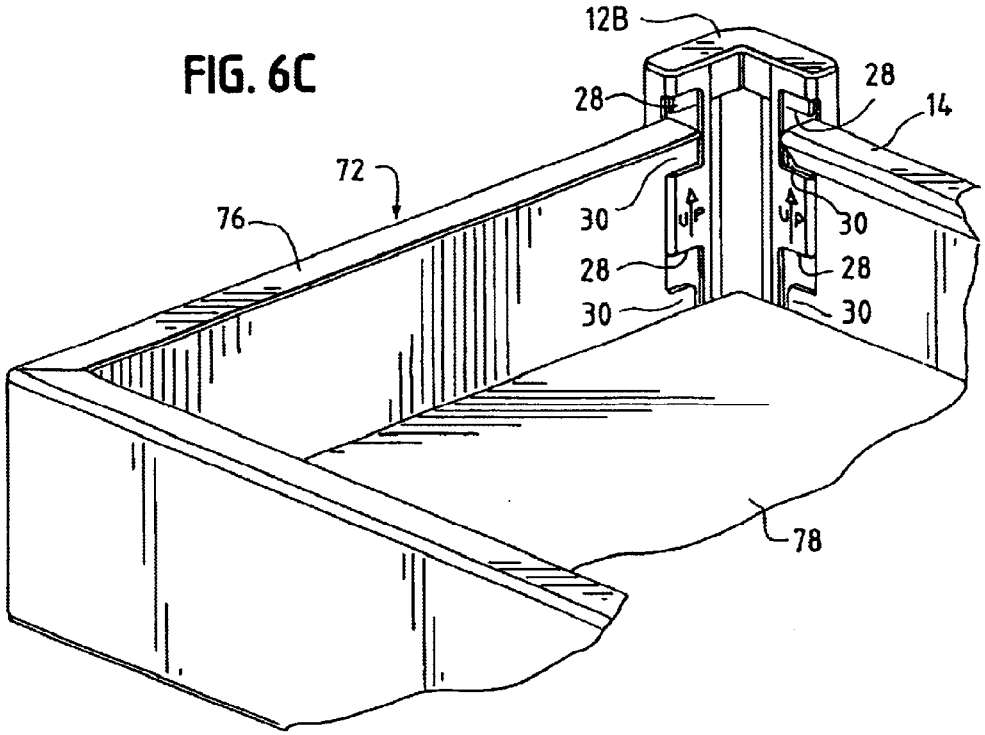

Referring to FIGS. 6A–6B, another embodiment of an assembled workbench 70 using the interlock mechanism of the present invention is depicted. The workbench 70 is assembled similar to the workbench 60 described above. The workbench 70 includes a heavy duty work tray 72, in place of the utility shelf 68 of the previously described embodiment, and also includes a drawer assembly 74. As FIG. 6C depicts, the work tray 72 includes a support frame 76 which interlocks with the back posts 12B using the interlock mechanism of the present invention. Tabs 30 of the support frame 76 are inserted into and engage post slots 28 of the posts 12B. The work tray 72 also includes a support surface 78 which is supported by the support frame 76. The drawer assembly 74 includes outer slide rails 80, inner slide rails 82 and a drawer 84. The outer slide rails 80 have tabs that insert into slots 28 on the posts 12B, 12L to connect the outer slide rails 80 to the workbench 70. The inner slide rails 82, in turn, connect to the drawer 84, and in the assembled workbench, the inner slides 82 of the drawer 84 are disposed within the outer slide rails 80 as illustrated in FIG. 6B.

Figure 7:
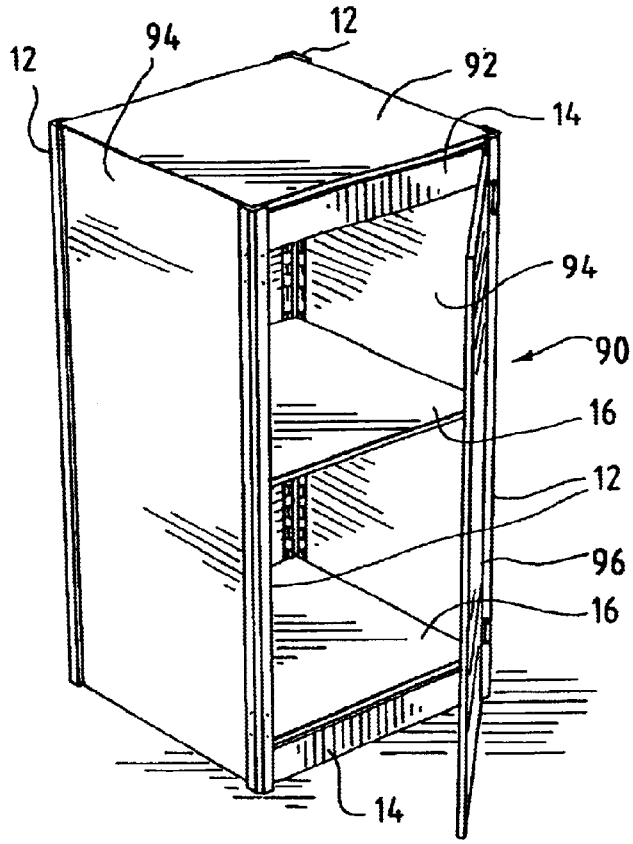
FIG. 7 illustrates an embodiment of an assembled cabinet of the present invention.

The present invention may also be used to configure a cabinet. Referring to FIG. 7, an embodiment of an assembled cabinet 90 using the interlock mechanism of the present invention is depicted. The cabinet 90, as with the workbenches 60, 70 and the shelving unit 10, has a number of posts (or support corners) 12 and a number of braces or aprons 14. To assemble the cabinet 90, the aprons 14 are connected to the support corners 12 in the same manner as aprons 14 are connected to the posts 12 for the shelving assembly and workbench assembly configurations. With all of the aprons 14 and support corners 12 connected, shelves 16, a top 92 and side panels 94 are then inserted into the cabinet unit. A door 96 is then attached to the front of the unit by attaching hinges to the door 96 and a front support corner 12. The cabinet 90, as with the shelving unit and the workbenches, may be distributed as a disassembled kit with the kit including the necessary support corners, apron, shelving, top, side panel and door pieces.

Figure 8:
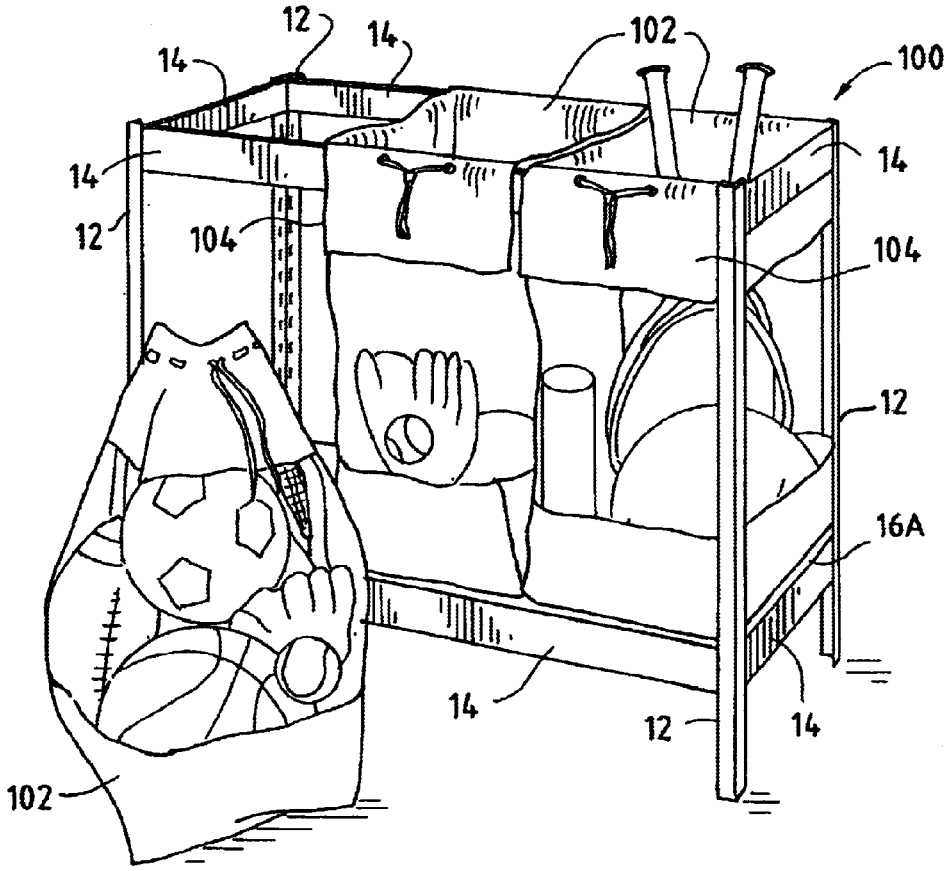
FIG. 8 illustrates an embodiment of an assembled storage assembly of the present invention.

Referring to FIG. 8, in another embodiment of the present invention, the interlock mechanism of the present invention may be used to configure a storage assembly 100. In the storage assembly 100, a set of posts 12 and aprons 14 are assembled in the manner described above in another embodiments to form a support structure. A bottom support surface 16A is placed on the bottom level of aprons 14. In this embodiment, the top level of aprons 14 do support a shelf or support surface. In this embodiment, storage bags 102, when stored, are disposed within the support structure. The top portion of the storage bags 102 have a flap 104 that folds over the outer aprons 14 and attaches back to the bag 102 (e.g., with Velcro or some other attachment means). When someone wants to take a storage bag 102 out of the storage assembly 100, he or she detaches the flap 104 and pulls the bag 102 out.

While the invention has been discussed in terms of preferred and specific embodiments, it should be appreciated by those of skill in the art that the invention is not so limited. The embodiments are explained herein by way of example, and there are numerous modifications, variations and other embodiments that may be employed that would still be within the scope of the present invention.

What is claimed is:

1. A kit for forming a support structure, comprising:

a plurality of posts having a pair of flanges, wherein each flange has a series of slots formed therein such that each slot has a slot lip having a thickness;

a plurality of aprons, wherein each apron has two ends and each end has at least one tab extending therefrom; wherein each tab defines a gap with a corresponding apron end and wherein the gap formed between each tab and apron end is narrower than the thickness of a slot lip; and at least one support panel, wherein, when the kit is assembled, each apron end tab is disposed in a flange slot creating an interference fit between the slot lip of the flange slot, the disposed apron end tab and the apron end and wherein a set of aprons support the support panel.

2. The kit for forming a support structure of claim 1, wherein each apron has at least two tabs on each end.

3. The kit for forming a support structure of claim 1, wherein the pair of post flanges define a channel.

4. The kit for forming a support structure of claim 3, further comprising a plurality of joiners which, when the unit is assembled, are each disposed in the corresponding post flanges.

5. The kit for forming a support structure of claim 3, further comprising a back stop panel, wherein, when the unit is assembled, the back stop panel is retained vertically in the channel.

6. The kit for forming a support structure of claim 1, wherein the formed support structure is a shelving assembly.

7. The kit for forming a support structure of claim 1, further comprising a joiner and a back stop panel, wherein the formed support structure is a workbench.

8. The kit for forming a support structure of claim 7, wherein the formed workbench includes a work tray and a drawer assembly.

9. The kit for forming a support structure of claim 1, further comprising a top panel, a plurality of side panels and a door, wherein the formed support structure is a cabinet.

10. The kit for forming a support structure of claim 1, further comprising a storage bag.

11. A support structure, comprising:

a plurality of posts, wherein each post has a pair of flanges with each flange having a series of slots formed therein such that each slot defines a slot lip having a thickness;

a plurality of aprons, wherein each apron has two ends with each end having an edge and at least a pair of end tabs extending from the edge, wherein each tab and respective apron edge define a gap that is narrower than the thickness of a slot lip and wherein each end tab is disposed in a respective flange slot such that the lip of the slot is disposed in the gap formed between the disposed end tab and the edge of the apron creating an interference fit; and a support panel, wherein the support panel rests on a set of the plurality of aprons.

12. The support structure of claim 11, wherein the pair of flanges of the post define a channel.

13. The support structure of claim 12, wherein the support panel has an edge and the post channel retains the support panel edge.

14. The support structure of claim further comprising a back stop, wherein the back stop is retained vertically in the channel.

15. A method for forming a support structure, comprising:

providing a plurality of posts, a plurality of aprons and a support panel, wherein each post has a pair of flanges with each flange having a series of slots formed therein such that each slot defines a slot lip having a thickness, and wherein each apron has two ends with each end having an edge and at least a pair of end tabs extending from the edge, wherein each tab and respective apron edge define a gap that is narrower than the thickness of a slot lip;

inserting the end tabs of one end of an apron into respective post flange slots;

inserting the slot lips of the flange into the gaps formed between the end tabs and the edge of the apron creating an interference fit;

inserting the end tabs at the other end of the apron into respective post flange slots of a second post;

inserting the slot lips of the flange of the second post into the gaps formed between the end tabs and the edge of the apron creating an interference fit;

continuing to insert apron end tabs into respective post flange slots to define a support structure; and placing the support panel on a set of the plurality of aprons.

16. The method for forming a support structure of claim 15, wherein the pair of flanges of the post define a channel.

17. The method for forming a support structure of claim 16, wherein the support panel has an edge, further comprising sliding the support panel edge into the post channel for retention of the support panel.

18. The method for forming a support structure of claim 16, further comprising providing a back stop piece and inserting the back stop piece vertically into the channel.

* * * * *